US006002378A

United States Patent [19]

Harada et al.

[11] Patent Number: 6,002,378

[45] Date of Patent: Dec. 14, 1999

[54] TELESCOPIC ROD ANTENNA APPARATUS

[75] Inventors: Jiro Harada; Shinichi Saito, both of Tokyo; Misao Kimura, Yokosuka, all of Japan

[73] Assignee: Harada Industry Co., Ltd., Tokyo, Japan

[21] Appl. No.: 09/037,388

[22] Filed: Mar. 10, 1998

[30] Foreign Application Priority Data

Dec. 19, 1997 [JP] Japan ..... 9-351321
Dec. 25, 1997 [JP] Japan ..... 9-358501

[51] Int. Cl.[6] ..... H01Q 1/10; H01Q 9/30

[52] U.S. Cl. ..... 343/903; 343/715; 343/901

[58] Field of Search ..... 343/715, 901, 343/900, 902, 903

[56] References Cited

U.S. PATENT DOCUMENTS 2,299,785 10/1942 Barrett ..... 343/903
2,491,629 12/1949 Vernier et al. ..... 343/903
3,116,691 1/1964 Tatel et al. ..... 343/903
4,647,936 3/1987 Harada ..... 343/901
4,660,049 4/1987 Shinkawa ..... 343/715
5,079,562 1/1992 Yarsunas et al. ..... 343/792

*Primary Examiner*—Don Wong
*Assistant Examiner*—Jennifer H. Malos
*Attorney, Agent, or Firm*—Koda & Androlia

[57] ABSTRACT

A telescopic rod antenna apparatus of the present invention includes a mechanism for extending/retracting a telescopic antenna element by operating a smallest-diameter one of rods of the antenna element, and a means for setting the rods in the second state where a tip portion of a largest-diameter rod contacts an O-shaped ring seal means and then extending the antenna element using the mechanism, setting the rods in the second state where the antenna element is retracted using the mechanism, and displacing the second state to the first state where the largest-diameter rod is returned to the initial position of a holding tube to bring a top portion into contact with the O-shaped ring seal means.

17 Claims, 7 Drawing Sheets

TELESCOPIC ROD ANTENNA APPARATUS

BACKGROUND OF THE INVENTION

The present invention relates to a telescopic rod antenna apparatus mounted on an automobile and the like and, more particularly, to a telescopic rod antenna apparatus having a waterproof means for preventing rainwater or the like from soaking into the antenna apparatus through a gap between an antenna element and an opening of an antenna holding tube.

Generally, in a prior art telescopic rod antenna apparatus, a telescopic antenna element, which is constituted by slidably coupling a plurality of rods of conductive tube members having different diameters, is insertably held in an antenna holding tube. The rod antenna apparatus so constituted has a gap between the antenna element and the opening of the antenna holding tube, a gap in a joint between a small-diameter rod and a large-diameter rod both constituting the telescopic antenna element, etc. It is thus likely that rainwater, washing, muddy water, etc. will soak into the antenna apparatus through such a gap.

Conventionally various measures have been taken against water entering the telescopic rod antenna apparatus. However, at present, there is no telescopic rod antenna apparatus capable of completely preventing water from soaking thereinto.

In arctic weather of winter, there are many cases where water is frozen in a telescopic rod antenna apparatus to make it impossible to extend an antenna by a driving motor.

The prior art telescopic rod antenna apparatus was inspected to find portions through which water such as rainwater soaks into the apparatus and know the reason why the water soaks into the apparatus. The following are results of the inspection.

(1) An antenna element constituted of a plurality of rods having different diameters and coupled slidably to each other is designed as follows. The retraction thereof is completed such that the end portion of a small-diameter rod is protruded a little more than that of a large-diameter rod in order to prevent a large gap from being formed in a joint between the rods. The end portion of the retracted antenna element looks like a roof portion of a multi-stored pagoda and contains the plural rods of different diameters arranged in tiers. A so-called top portion is provided at the tip portion of the smallest-diameter rod which is the top of the antenna element. Generally the top portion is so designed that its outside diameter is equal to that of the largest-diameter rod.

The telescopic rod antenna apparatus capable of insertably holding the above telescopic antenna element in a holding tube, has the following two types. One type is that an antenna element having rods in tiers is held in a holding tube such that its tip portion is projected from the holding tube. The other is that an antenna element is held in a holding tube almost completely such that its tip portion is buried in the holding tube and its top portion is located at the opening of the holding tube. Hereinafter the former is called a top-portion projected type, and the latter is called a top-portion buried type.

In the telescopic rod antenna apparatus of the top-portion projected type, when the antenna element is held in the holding tube, the largest-diameter rod is inserted into the opening of the holding tube with almost no gap therebetween. Thus, it is not so likely that rainwater will enter the holding tube through the opening of the tube. Since, however, the antenna element is held in the holding tube incompletely, the tip portion or the top portion of the antenna element, projected from the holding tube, is likely to contact an obstacle and break.

The telescopic rod antenna apparatus of the top-portion buried type does not cause the drawback of the projected type apparatus since the antenna element is held in the holding tube almost completely. Moreover, the top portion of the antenna element is inserted into the opening of the holding tube with almost no gap therebetween, so that it is not so likely that rainwater will enter the holding tube through the opening of the tube. However, as described below, there is a possibility that rainwater or the like will relatively easily soak into the holding tube when the antenna element is extended or retracted.

If the smallest-diameter rod is projected from the holding tube when the antenna element is extended, a great gap will appear between the inner surface of the opening of the holding tube and the tip portion of the antenna element of rods in tiers during a period of time (which corresponds to about 80% of the time required for extending the antenna element completely) from when the top portion goes out of the opening of the holding tube until the largest-diameter rod is projected from the holding tube.

It is thus likely that rainwater will easily soak into the holding tube through the great gap. Even when the antenna element is retracted, if the largest-diameter rod is held earlier than the small-diameter rod (which will occur in a conventional telescopic rod antenna apparatus), a gap is caused during a period of time from when the largest-diameter rod is held in the holding tube until the smallest-diameter rod is held therein; therefore, rainwater is likely to soak into the tube.

(2) Since it has been thought that the phenomenon of (1) cannot be prevented completely, no specific waterproof means has been provided at the opening of the holding tube. Thus, water soaking into the holding tube is drained out of a drain provided at the lower end of the holding tube.

In the telescopic rod antenna apparatus of the top-portion buried type, even though the antenna element is held completely in the holding tube, rainwater is likely to soak into the tube through a gap between the top portion and the opening, since the holding tube has no specific waterproof means at the opening. In the telescopic rod antenna apparatus of the top-portion projected type, even though the antenna element is held completely in the holding tube, rainwater is likely to soak into the tube through a gap between the largest-diameter rod and the opening for the same reason described above.

(3) Of the rods constituting the antenna element of the telescopic rod antenna apparatus, the smallest-diameter rod has a so-called, slightly roundish top portion at the tip portion. This top portion is attached to the tip portion of the smallest-diameter rod as follows. A columnar portion protruded from the lower end of the top portion is pressed into a hollow of the tip portion of the smallest-diameter rod and then the outer surface of the tip portion of the rod is caulked with a ring at two points. The ring-caulking causes a slight irregularity or distortion on the outer surface of the smallest-diameter rod. If the irregularity or distortion is relatively great, a gap will occur between the outer surface of the smallest-diameter rod and the inner surface of the subsequent rod when the antenna element is retracted, and rainwater is likely to soak into the rods through the gap.

(4) It is likely that a very small amount of rainwater will enter the rods through a gap in a joint between the smallest-diameter rod and the large-diameter rod constituting the telescopic antenna element.

As described above, the conventional telescopic rod antenna apparatus has a problem in which rainwater or the like soaks into the antenna through a gap between the end portion of the antenna element and the opening of the holding tube when the antenna element is extended or retracted in the top-portion buried type antenna apparatus, a gap between the top portion and the opening of the holding tube when the antenna element is held in the tube in the top-portion buried type antenna apparatus, a gap between the largest-diameter rod and the opening of the holding tube when the antenna element is held in the tube in the top-portion projected type antenna apparatus, a gap between the smallest-diameter rod and the subsequent rod constituting the telescopic antenna element, a gap in the joint between the smallest-diameter rod and the largest-diameter rod, etc, thereby to cause various problems.

BRIEF SUMMARY OF THE INVENTION

It is accordingly an object of the present invention to provide a telescopic rod antenna apparatus which is simple in constitution and low in manufacturing cost and which has the advantages of stably lasting a very good waterproof effect for a long time, preventing an antenna element from being frozen or damaged to avoid increasing in load of the antenna element, reducing a driving force for extending and retracting the antenna element to use a small-sized, low-powered driving motor, and decreasing an operation noise caused when the antenna element is extended or retracted.

To achieve the above object, a telescopic rod antenna apparatus according to the present invention has the following constructions. The other characteristic constructions will be described later in the embodiments of the present invention.

The telescopic rod antenna apparatus comprises:

an antenna element constituted by slidably coupling a plurality of rods to each other, the rods being formed of conductive tube members having different diameters;

a holding tube into which the antenna element is held insertably;

an extending/retracting mechanism for extending the antenna element by projecting a smallest-diameter rod of the antenna element outside another rod and retracting the antenna element by pulling the smallest-diameter rod into another rod;

displacement means for displacing a largest-diameter rod outside the holding tube when the antenna element starts to be extended by the extending/retracting mechanism to shift the rods from a first state in which a top portion attached to a tip portion of the smallest-diameter rod is located in an opening of the holding tube to a second state in which a tip portion of the largest-diameter rod is located in the opening of the holding tube;

extension means for, after the rods are shifted to the second state by the displacement means, extending the antenna element using the extending/retracting mechanism to project each of the rods outside the largest-diameter rod;

retraction means for retracting the antenna element using the extending/retraction mechanism to pull each of the rods into the largest-diameter rod and set the largest-diameter rod in the second state; and means for, after the antenna element is retracted by the retraction means, pulling the largest-diameter rod into an initial position of the holding tube when the antenna element ends the retracting operation performed by the extending/retracting mechanism and set the antenna element to the first state.

Further, the above telescopic rod antenna apparatus comprises:

O-shaped ring seal means attached to an opening of the holding tube so as to contact a largest-diameter portion of the antenna element fluid-tightly;

a top portion provided at a tip portion of a smallest-diameter rod of the antenna element and including a short cylinder member fixed onto the outer surface of a smaller-diameter portion of the tip portion of the smallest-diameter rod and a stopper member inserted and fixed into the smallest-diameter rod such that an opening end of the short cylinder member is sealed at the tip portion of the smallest-diameter rod; and a ring-shaped seal member constituted by rolling a film strip, which is made of thermoplastic resin and has one or plural projecting portions in a longitudinal direction, like a ring and then compressing and inserting the rolled film strip into a ring-shaped gap in a joint between a smaller-diameter rod and a larger-diameter rod, the ring-shaped seal member being provided for fluid-tightly sealing a gap between the outer surface of the smaller-diameter rod and the inner surface of the larger-diameter rod by adhering a plurality of ring-shaped contact portions, which are formed along a longitudinal direction on both sides of the film strip when the one or plural projecting portions serve as basic contact portions, to the inner surface of the larger-diameter rod and the outer surface of the smaller-diameter rod at a predetermined pressure.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

First Embodiment

Figure 1:
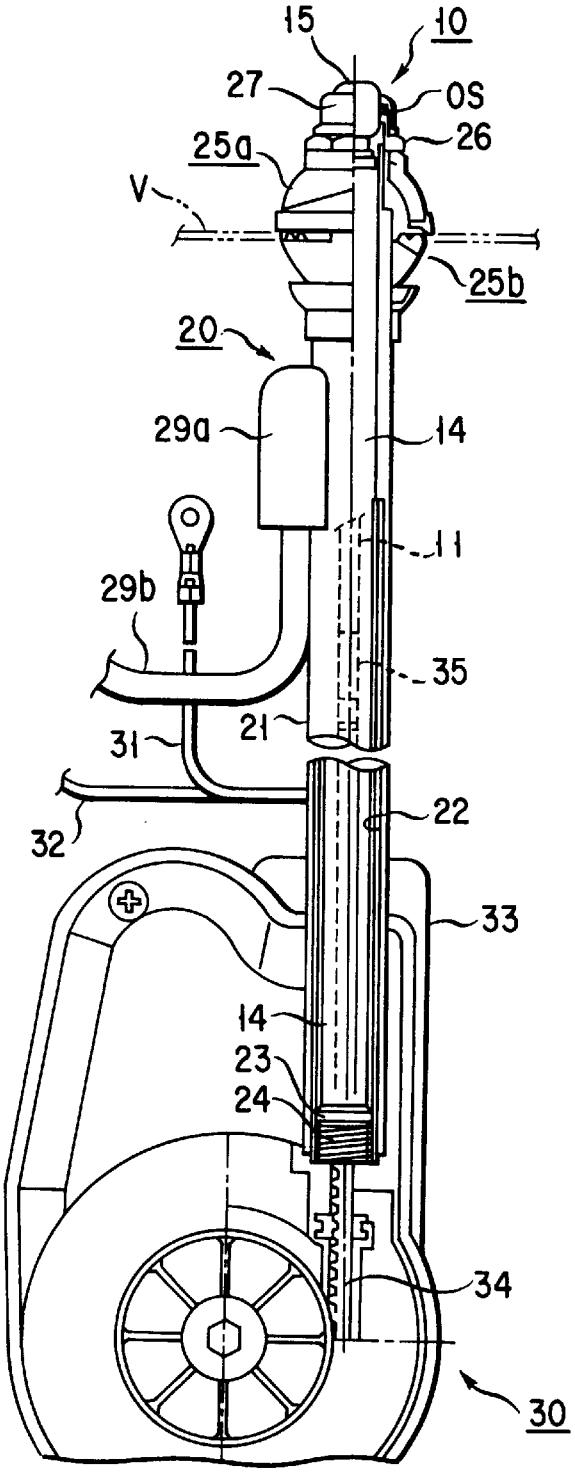
FIG. 1 is a schematic view showing the constitution of a telescopic rod antenna apparatus according to a first embodiment of the present invention, which is set in a first state.
Figure 2:
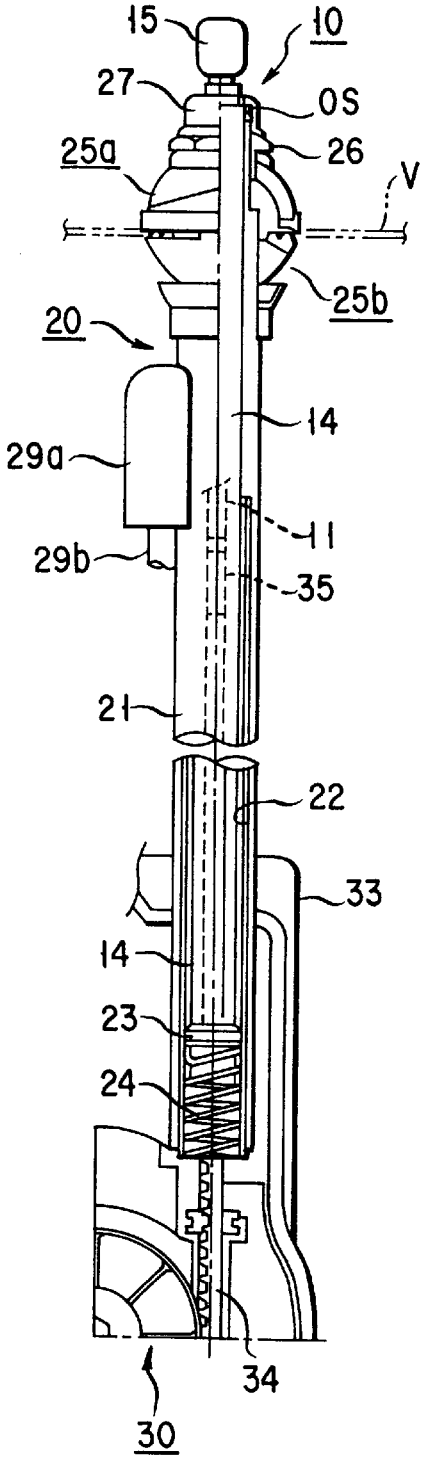
FIG. 2 is a schematic view showing the constitution of the telescopic rod antenna apparatus according to the first embodiment of the present invention, which is set in a second state.

FIG. 1 is a schematic view showing the constitution of a telescopic rod antenna apparatus according to a first embodiment of the present invention, which is set in a first state where an antenna element is held completely in a holding tube. FIG. 2 is also a schematic view showing the constitution of the telescopic rod antenna apparatus in a second state where an antenna element is displaced to a predetermined position by a displacement means immediately after the antenna element starts to extend or immediately before it completes retracting.

In FIGS. 1 and 2, reference numeral 10 indicates a telescopic antenna element, 20 shows a holding tube, and 30 denotes an electric antenna extending/retracting mechanism.

Figure 3:
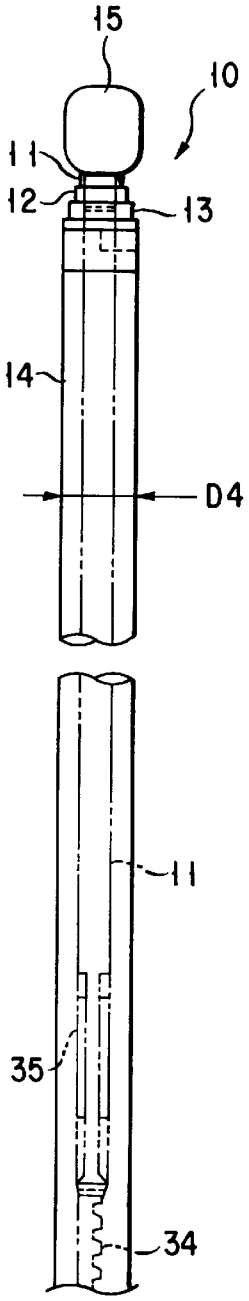
FIG. 3 is a view illustrating the construction of a retracted rod antenna of the telescopic rod antenna apparatus according to the first embodiment of the present invention.
Figure 4:
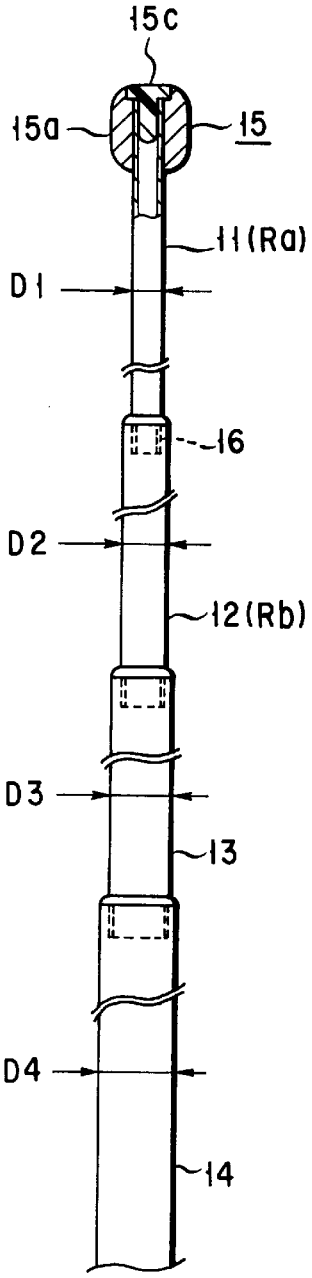
FIG. 4 is a view illustrating the construction of an extended rod antenna of the telescopic rod antenna apparatus according to the first embodiment of the present invention.

As is apparent from FIGS. 3 and 4, the telescopic antenna element 10 includes a plurality of rods 11 to 14 (four in this embodiment) constituted of conductive tube members and having different outside diameters D1 to D4 which are increased in order. These rods are slidably coupled to each other and insertably held in the holding tube 20.

Figure 5:
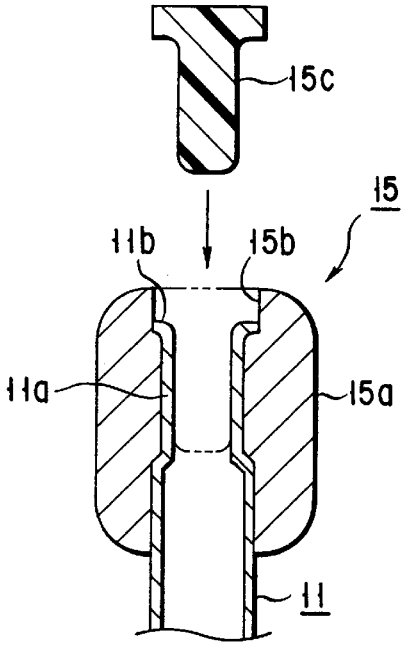
FIG. 5 is a cross-sectional view illustrating the construction of a top portion of the telescopic rod antenna apparatus according to the first embodiment of the present invention.

As illustrated in FIG. 4, a roundish top portion 15 is attached to the tip portion of the smallest-diameter rod of the antenna element 10. As shown in detail in FIG. 5, a small-diameter portion 11*a* is formed in advance at the tip portion of the rod 11, a metallic, short cylinder member 15*a* is fixed onto the outer surface of the small-diameter portion 11*a*, and a stopper member 15*c*, which is made of, e.g., resin, is pressed and fixed (or bonded) to the rod 11 in the direction of an arrow such that an opening end 15*b* of a hollow of the short cylinder member 15*a* is sealed with the end portion of the rod 11.

In order to prevent the short cylinder member 15*a* from coming out of the small-diameter portion 11*a*, an end opening portion 11*b* of the smallest-diameter rod 11 is expanded at the opening end 15*b* by a pressure means such as a press mechanism. This expansion processing is executed locally only at the end opening portion 11*b* of the rod 11. Thus, irregularities or distortion, which has been conventionally caused by ring-caulking, does not appear at the tip portion of the rod 11.

It is thus unlikely that a gap will be formed between the smallest-diameter rod 11 and its subsequent rod 12 by irregularities or distortion; therefore, rainwater or the like can be prevented from soaking into the rods.

As illustrated in FIG. 4, a ring-shaped seal member 16, which is made of thermoplastic resin (e.g., ethylene tetrafluoride resin), is inserted in a ring-shaped gap at a joint between the smaller-diameter rod (Ra) and its subsequent larger-diameter rod (Rb) of the antenna element 10. Specifically, the ring-shaped seal member 16 is inserted in a ring-shaped gap at each of joints between the smallest-diameter rod 11 (Ra) and the second rod 12 (Rb), between the second rod 12 (Ra) and the third rod 13 (Rb), and between the third rod 13 (Ra) and the largest-diameter rod 14 (Rb). To obtain the ring-shaped seal member 16 as shown in FIG. 6, a film strip 17 of thermoplastic resin is inserted into the ring-shaped gap and compressed in its width direction.

In other words, the seal member 16 is formed by pressing and connecting both end portions M and N of the film strip 17 to each other and then curving the ring-shaped member in its width direction so as to swell outwardly.

Thus, ring-shaped contact portions A and B formed on both the rims of the seal member 16, are adhered to the outer surface of the smaller-diameter rod (Ra) at a predetermined pressure, while a ringed contact portion C (indicated by a two-dots-one-dash line) formed along the centerline on the outer surface of the member 16, is adhered to the inner surface of the larger-diameter rod (Rb) at a predetermined pressure. Therefore, a gap between the outer surface of the smaller-diameter rod (Ra) and the inner surface of the larger-diameter rod (Rb) is sealed fluid-tightly to prevent rainwater or the like from soaking into the rods through the joint between the smaller-diameter rod (Ra) and the larger-diameter rod (Rb).

Figure 6:
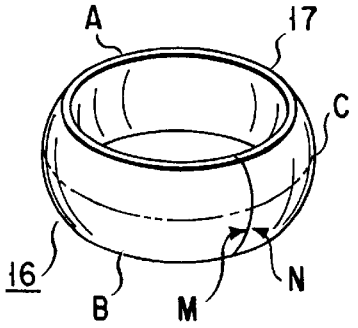
FIG. 6 is a perspective view of a ring-shaped seal member of the telescopic rod antenna apparatus according to the first embodiment of the present invention.

The ring-shaped seal member 16 illustrated in FIG. 6 is publicly known as disclosed in Jpn. U.M. Appln. KOKOKU Publication No. 4-38563.

Figure 7:
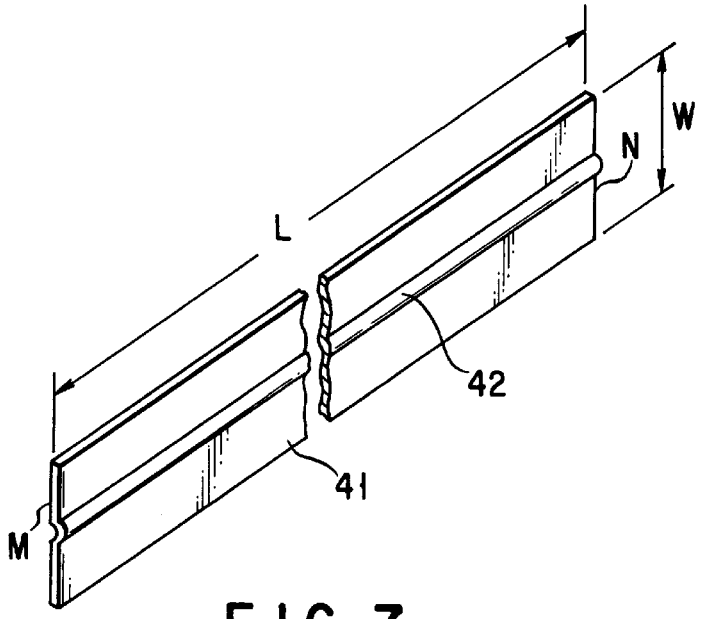
FIG. 7 is a perspective view showing an improved film strip of the ring-shaped seal member of the telescopic rod antenna apparatus according to the first embodiment of the present invention.
Figure 8:
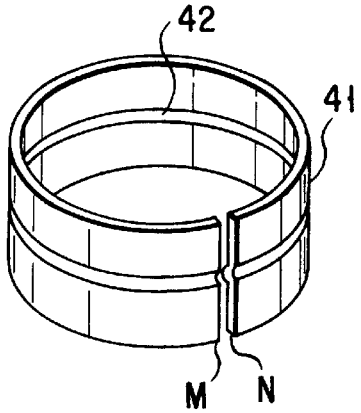
FIG. 8 is a perspective view of the film strip shown in FIG. 7, which is rolled like a ring.
Figure 9:
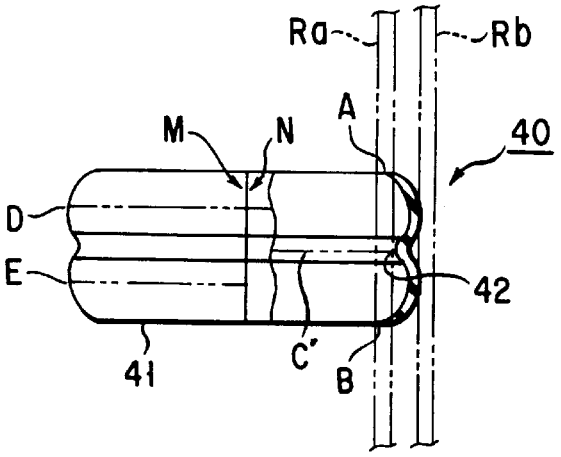
FIG. 9 is a side view of the improved ring-shaped seal member, which is partly cut.

FIGS. 7 to 10 each illustrate an improvement of the known ring-shaped seal member 16 in which a projecting portion serving as a basic contact portion is added to the member 16 to exaggerate the ring-shaped contact portion thereon. More specifically, as shown in FIG. 7, a thermoplastic resin film strip 41 having a length of L and a width of W includes a corrugated, curved, projecting portion 42 formed along the centerline on one side thereof. In order to change the film strip 41 into a ring-shaped seal member 40 serving as a waterproof means, the film strip 41 is rolled like a ring, with the projecting portion 42 inside, as shown in FIG. 8, and the ringed film 41 is inserted into a ring-shaped gap in each joint between the smaller-diameter rod (Ra) and the larger-diameter rod (Rb). If the antenna element 10 is extended, the ringed film 41 inserted into the ring-shaped gap is put between the distal end portion of the smaller-diameter rod (Ra) and the tip portion of the larger-diameter rod (Rb) and compressed in its width direction, with the result that the ringed film 41 is curved, as shown in FIG. 9 to obtain a ring-shaped seal member 40.

As illustrated in FIG. 9, the ring-shaped seal member 40 is obtained by pressing and connecting both end portions M and N of the film strip 41 to each other, and ring-shaped contact portions A to E formed on the film strip 41 are brought into contact with the outer surface of the smaller-diameter rod (Ra) and the inner surface of the larger-diameter rod (Rb) at a predetermined pressure.

More specifically, ring-shaped contact portions A and B formed on both the rims of the film strip 41 and a ring-shaped contact portion C' (corresponding to the projecting portion 42) formed along the centerline on the inner surface of the film strip 41, are adhered to the outer surface of the smaller-diameter rod (Ra) at a predetermined pressure.

Furthermore, ring-shaped contact portions D and E, each of which is formed along the centerline on the curved portion of each of regions into which the film strip 41 is divided by the projecting portion 42, are placed into contact with the inner surface of the larger-diameter rod (Rb).

As a result, a gap between the outer surface of the smaller-diameter rod (Ra) and the inner surface of the larger-diameter rod (Rb) is sealed fluid-tightly several times by the plural ring-shaped contact portions A to E. Consequently, rainwater or the like can be prevented from soaking into the rods through a joint between the smaller-diameter rod (Ra) and larger-diameter rod (Rb).

Figure 10:
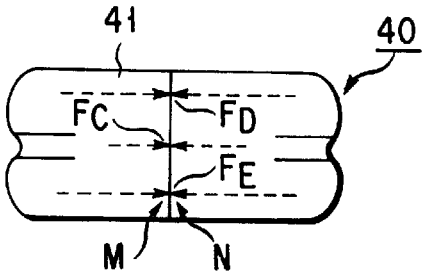
FIG. 10 is a view for explaining a method of forming the ring-shaped seal member shown in FIG. 9 by performing a compression deformation operation.

FIGS. 9 and 10 are views for explaining a method of forming the ring-shaped seal member 40 by performing a compression deformation operation. Since the outer periphery of the film strip 41, which is rolled like a ring and inserted into the larger-diameter rod (Rb), is surrounded with the inner surface of the larger-diameter rod (Rb), the strip 41 is prevented from being enlarged and deformed outside. It is also prevented from being reduced and deformed inside by the outer surface of the smaller-diameter rod (Rb) inserted into the film strip 41. For this reason, if the film strip 41 is compressed in the axial direction of the rod, two regions into which the strip 41 is divided by the projecting portion 42, are curved and deformed in the width direction. Since there are no other things for absorbing the compression force continuously applied to the strip 41, both ends M and N of the film strip 41 in the longitudinal direction are compressed and brought into close contact with each other as shown in FIGS. 9 and 10. The force applied to the contact face between the end portions M and N is influenced by variations in measurements in the longitudinal direction due to the curvature of the film strip 41 in the width direction. As the force is represented as the length of a broken line in FIG. 10, force $F_D$ and force $F_E$ applied to the vicinities of both peripheries, are relatively greater than force $F_C$ applied to the central part of the contact face between the end portions M and N. In this case, however, no gap occurs at the central part of the contact face, and the end portions M and N adhesively contact each other, with the result that the ring-shaped seal member 40 can be formed like an almost complete ring.

Figure 11:
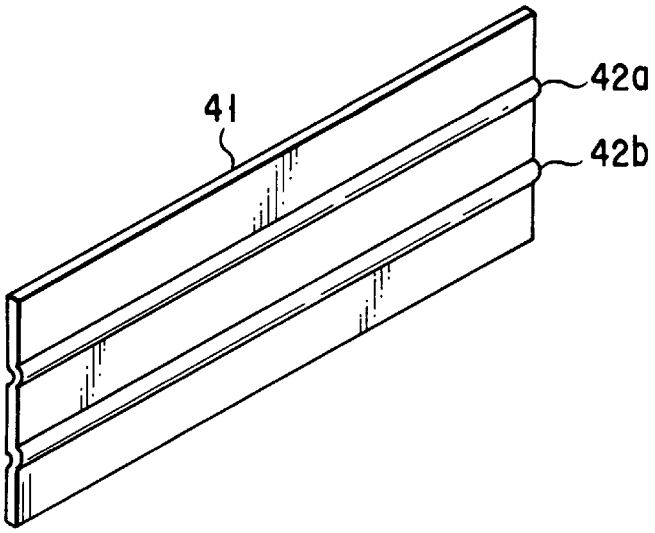
FIG. 11 is a perspective view of a modification to the film strip shown in FIG. 7.
Figure 12:
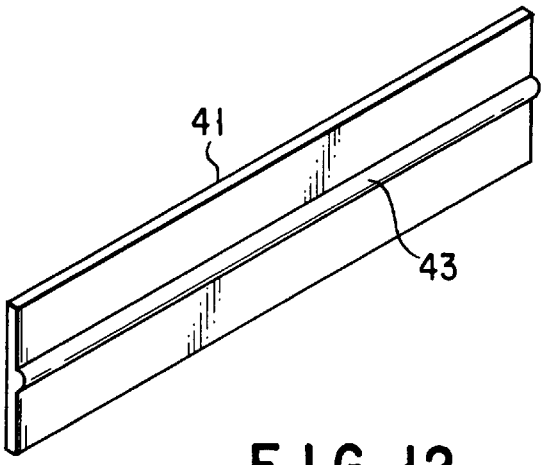
FIG. 12 is a perspective view of another modification to the film strip shown in FIG. 7.

The film strip 41 can be provided with a plurality of projecting portions 42*a* and 42*b* (two in this embodiment), as illustrated in FIG. 11. Otherwise, as shown in FIG. 12, a swelled, projecting portion 43 can be formed on one side of the film strip 41.

Returning to FIGS. 1 and 2, the holding tube 20 includes an outer tube 21 and an inner tube 22, and the antenna element 10 is insertably held in the holding tube 20. A short columnar rod supporting member 23, which is made of, e.g., resin, is mounted on the bottom of the holding tube 20 such that it can be slid therein. The rod supporting member 23 has a flange section on the top thereof to support the distal-end of the largest-diameter rod 14. A cylindrical section of the member 23, located below in FIGS. 1 and 2, is wound with a coil spring 24 as a spring member constituting a displacement means.

As illustrated in FIG. 1, when the antenna element 10 is held completely, the coil spring 24 is compressed by the distal end of the largest-diameter rod 14 which is retracted by rope 34 (described later). The repulsion of the coil spring 24 is therefore constantly applied to the rod 14 through the rod supporting member 23 as a force displaced upward in FIG. 1.

An external mounting member 25*a* and an internal mounting member 25*b* are attached to the upper portion (in FIGS. 1 and 2) of the holding tube 20. These members 25*a* and 25*b* are used to fix the rod antenna apparatus on an object to be mounted, such as a car body V, by pressing the car body V from both sides.

A fixed nut 26 is used to fix the mounting members 25*a* and 25*b* and engaged with a screw portion formed in the upper end portion of the holding tube 20. A cap 27 is coupled to the upper side portion of the fixed nut 26 integrally as one component in order to close the opening of the holding tube 20, except for a hole through which the antenna element 10 passes. An O-shaped ring seal mechanism OS serving as a waterproof means is provided at the coupling portion of the nut 26 and cap 27.

Figure 13:
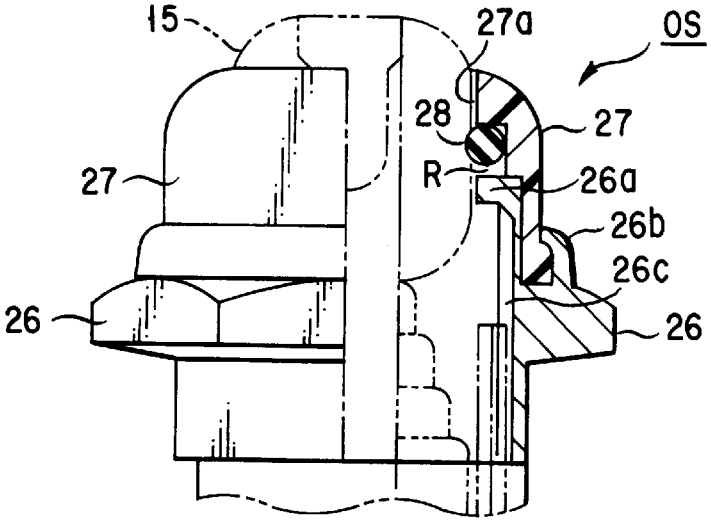
FIG. 13 is a view of the structure of an O-shaped ring sealing mechanism of the telescopic rod antenna apparatus according to the first embodiment of the present invention.

The structure of the O-shaped ring seal mechanism OS is illustrated in FIG. 13. As shown, the distal end of the cap 27 is fitted to the head portion of the fixed nut 26 and then part 26*b* of the fixed nut 26 is caulked with the distal end of the cap 27, thereby coupling the cap 27 to the fixed nut 26 integrally with each other as one component. This coupling produces a recess R therebetween and, more specifically, the recess R is formed between a flange portion 26*a* provided on the inner periphery of the top portion of the fixed nut 26 and a flange portion 27*a* provided on the inner periphery of the head portion of the cap 27.

If an O-shaped ring 28, which is made of, e.g., rubber, is inserted in a region where the recess R is to be formed and then the cap 27 is fitted to the fixed nut 26, the O-shaped ring seal mechanism OS is finished. Since the O-shaped ring 28 need not be fitted into the recess R, an assembly operation can be performed very simply.

Consequently, the O-shaped ring 28 of the O-shaped ring seal mechanism can be brought into fluid-tight contact with the largest-diameter portion of the antenna element 10 (the outer circumference of the largest-diameter rod 14 and that of the top portion 15).

As shown in FIG. 1, therefore, rainwater or the like can be prevented from soaking into the holding tube 20 through a gap between the top portion 15 and the opening of the holding tube when the antenna element 10 is completely retracted or a gap between the largest-diameter rod 14 and the opening of the holding tube when the antenna element 10 is extended. In FIG. 1, numeral 29*a* denotes a power supply portion provided at the holding tube 20, and numeral 29*b* indicates a feeder connected to the power supply portion.

Referring to FIG. 1, the electric antenna element extending/retracting mechanism 30 is coupled to the distal end portion of the holding tube 20. This mechanism 30 includes a driving motor 33 for controlling forward/backward rotation by power supplied through motor controlling leads 31 and 32, a rope transfer mechanism (not shown) having a worm gear, a worm wheel, a reduction gear, and a rope feeding pinion, and a rack-attached rope 34 transferred by the pinion in the longitudinal direction. The end of the rope 34 is connected to the distal end of the smallest-diameter rod 11 through a joint 35.

The antenna element extending/retracting mechanism 30 causes the smallest-diameter rod 11 to project from another rod by the transfer force of the rack-attached rope 34 to extend the antenna element 10, while it pulls the rod 11 into another rod by the transfer force of the rope 34 to retract the antenna element 10.

The telescopic rod antenna apparatus of the first embodiment includes a displacement means for displacing the largest-diameter rod 14 outward from the holding tube 20 by a predetermined distance when the antenna element 10 is extended by the antenna extending/retracting mechanism 30. The displacement means is intended to displace the rods from the first state shown in FIG. 1 (the top portion 15 attached to the end portion of the smallest-diameter rod 11 is located at the opening of the holding tube 20) to the second state shown in FIG. 2 (the end portion of the largest-diameter rod 14 is located at the opening of the holding tube 20). The displacement means includes the rod supporting member 23 and the coil spring 24 serving as a spring member.

The telescopic rod antenna apparatus also includes an extension means for, after the rods are displaced to the second state by the displacement means, extending the antenna element 10 using the antenna extending/retracting mechanism 30 to project each rod outside from the largest-diameter rod 14.

Furthermore, the telescopic rod antenna apparatus includes a retraction means for retracting the antenna element 10 using the mechanism 30 to pull each rod into the largest-diameter rod 14 and set the rod 14 in the second state.

Moreover, the apparatus includes a means for, after the element 10 is retracted completed by the retraction means, pulling the largest-diameter rod 14 to the initial position in the holding tube 20 when the antenna element ends its retraction operation performed by the mechanism 30 thereby to set the antenna element 10 in the first state.

Figure 14:
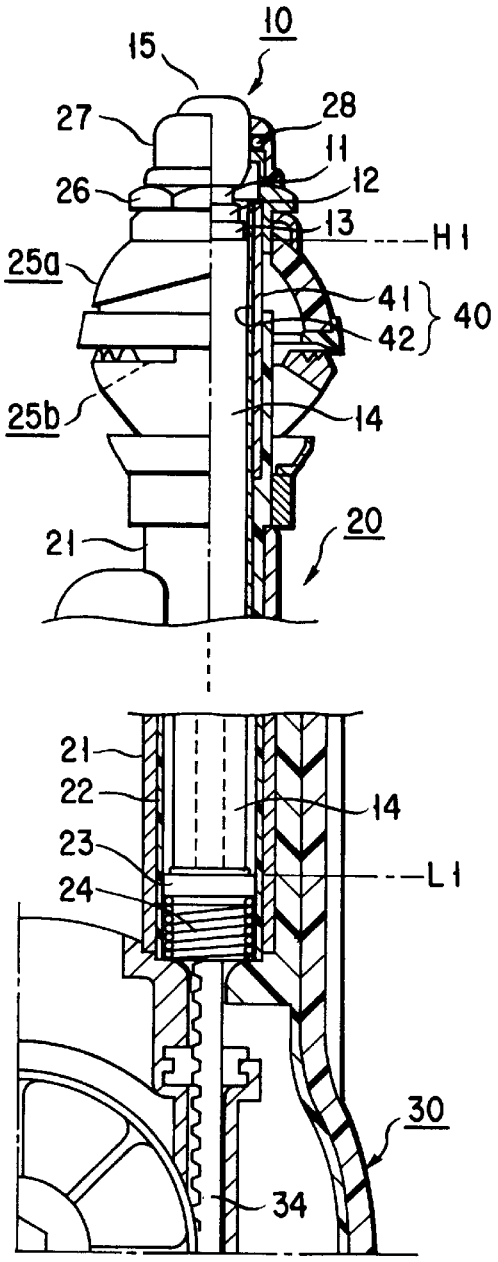
FIG. 14 is a view showing a correlation (first state) between the O-shaped ring sealing mechanism of FIG. 13 and the largest-diameter rod displacement means.
Figure 15:
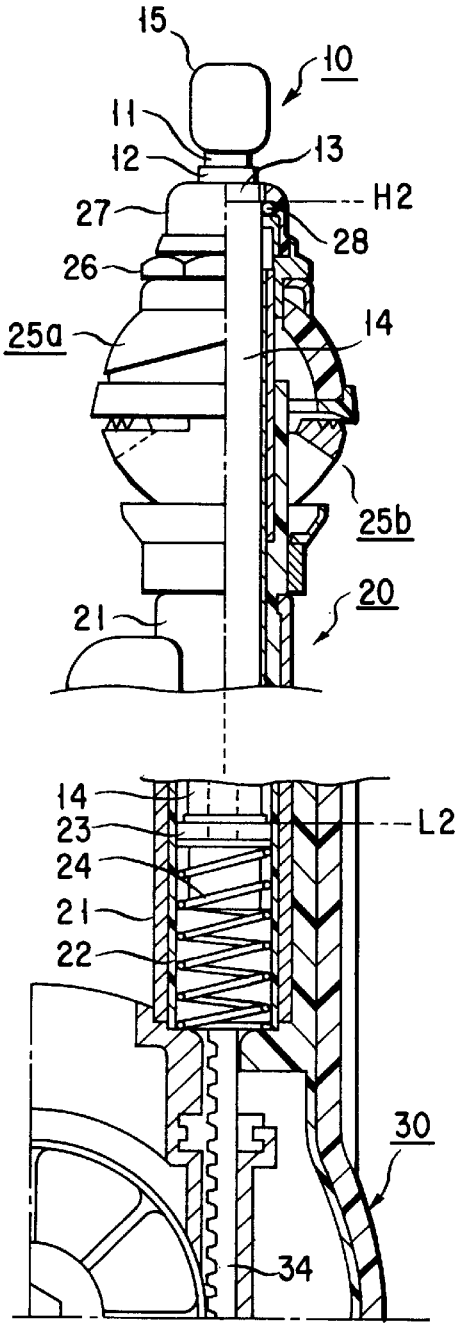
FIG. 15 is a view showing another correlation (second state) between the O-shaped ring sealing mechanism of FIG. 13 and the largest-diameter rod displacement means.

FIGS. 14 and 15 are enlarged views of the main parts of the apparatus shown in FIGS. 1 and 2, which illustrate a correlation between the O-shaped ring sealing mechanism OS and the largest-diameter rod displacement means 23 and 24.

As has been described above, since the coil spring 24 is compressed and mounted between the bottom of the holding tube 20 and the distal end of the largest-diameter rod 14, a displacement force, which is capable of displacing the largest-diameter rod 14 upward (in the Figures) to a predetermined position of the holding tube 20 by repulsion of the coil spring 24, is applied to the rod 14.

FIG. 14 illustrates the first state described above. In this state, when the antenna apparatus is not used, the antenna element 10 is retracted by the antenna extending/retracting mechanism 30 and completely held into the holding tube 20 by the rack-attached rope 34.

In the first state, the distal end of the rod 14 is pulled into the initial position of the holding tube 20, or level L1 and held against the displacement force of the coil spring 24. The tip portion of the largest-diameter rod 14 is located at level H1 under the O-shaped ring 28 (in FIG. 14), and the top portion 15 is located in contact with the ring 28.

FIG. 15 shows the foregoing second state. This second state is a state immediately after the antenna element 10 starts to extend or immediately before it completed retracting. More specifically, the antenna element 10 is not retracted or held by the rack-attached rope 34 against the displacement force of the coil spring 24 but the largest-diameter rod 14 is displaced to a predetermined position by the displacement force of the coil spring 24.

In the second state, the distal end of the largest-diameter rod 14 is displaced to a predetermined position of the holding tube 20 or level L2 by the displacement force of the coil spring 24. The tip portion of the largest-diameter rod 14 is then located in a position of the O-shaped ring 28 or at level H2, and the top portion 15 is projected outward from the cap 27 by a predetermined amount.

An operation and a function of the rod antenna apparatus according to the first embodiment having the above constitution, will now be described.

If the antenna extending/retracting mechanism 30 is operated to extend the antenna element 10, the driving motor 33 is rotated forward and the rack-attached rope 34 is sent outside the holding tube 20. Then, the smallest-diameter rod 11 of the antenna element 10 starts to extend outward from the holding tube 20. Since, therefore, the pulling holding force of the rope 34, which has been applied to the largest-diameter rod 14 so far, is released, the rod 14 is displaced outward from the holding tube 20 by the displacement force of the coil spring 24 while holding the other rods. In other words, the rod 14 is shifted from the first state of FIG. 14 to the second state of FIG. 15.

The top portion 15 deviates from the position of the O-shaped ring 28 and is protruded outward from the holding tube 20. Instead, the tip portion of the largest-diameter rod 14 arrives at the position of the O-shaped ring 28, and the time required for this change is only about 0.06 seconds.

It is only during a very short period of time of 0.06 seconds that rainwater or the like enters the holding tube 20. The possibility of this is considered to be virtually zero.

Figure 16:
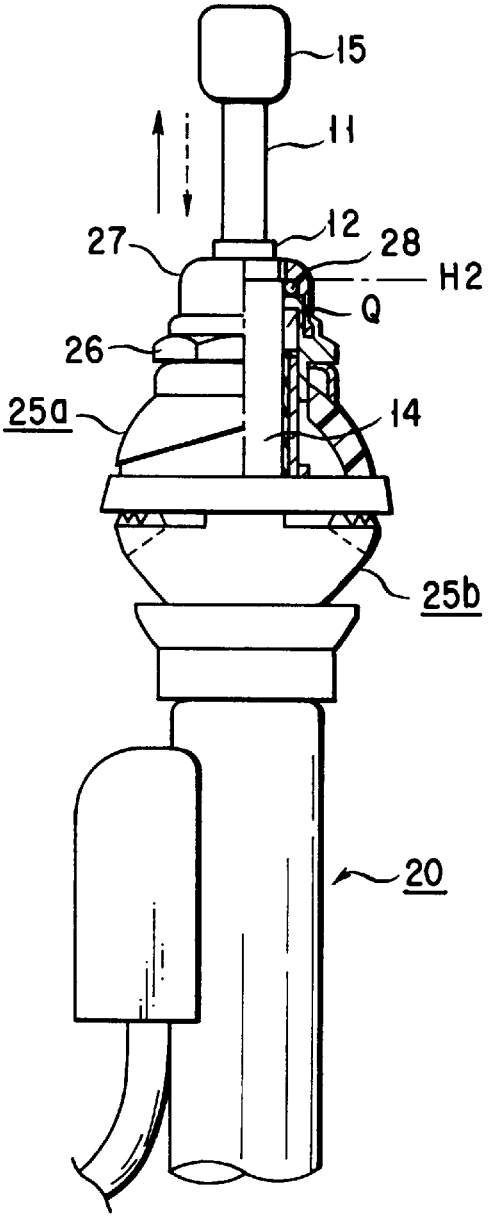
FIG. 16 is a view for explaining the merits of the telescopic rod antenna apparatus according to the first embodiment of the present invention when it has the largest-diameter rod displacement means.

If the antenna extending/retracting mechanism 30 continues to operate, a projecting operation starts with the smallest-diameter rod 11 and ends with the largest-diameter rod 14, as indicated by the solid arrow in FIG. 16, like the extending operation of a normal telescopic rod antenna apparatus.

If the mechanism 30 is operated to retract the antenna element 10, the driving motor 33 rotates backward and the rack-attached rope 34 is pulled into the holding tube 20. The smallest-diameter rod 11 of the antenna element 10 starts to retract inside the holding tube 20. The other rods start in sequence to retract inside the holding tube 20 simultaneously with or later than the smallest-diameter rod 11. This retracting operation is not always performed in sequence from the smaller-diameter rod (Ra).

If the largest-diameter rod 14 is retracted inside the holding tube 20 and the tip portion of largest-diameter rod 14 is held in the vicinity of the O-shaped ring 28, the outward displacement force is applied again to the rod 14 by the coil spring 24. As a result, as illustrated in FIG. 16, the largest-diameter rod 14 stops in the position of the O-shaped ring 28 and stands by for the other rod to be held into the rod 14 as indicated by the broken arrow.

If the mechanism 30 continues to operate after the second state shown in FIG. 15 where the other rods are all held in the largest-diameter rod 14, the rod 14 compresses the coil spring 24 against the displacement force of the spring 24 while holding the other rods therein, the rod 14 is shifted to the first state as shown in FIG. 14.

The largest-diameter rod 14 deviates from the position of the O-shaped ring 28 and is pulled into the holding tube, and the top portion 15 arrives at the position of the O-shaped ring 28 instead. The time required for this change is virtually about 0.06 seconds as in the extending operation.

It is only during a very short period of time of 0.06 seconds that rainwater or the like enters the holding tube 20. The possibility of this is considered to be virtually zero, as in the extending operation.

Figure 17:
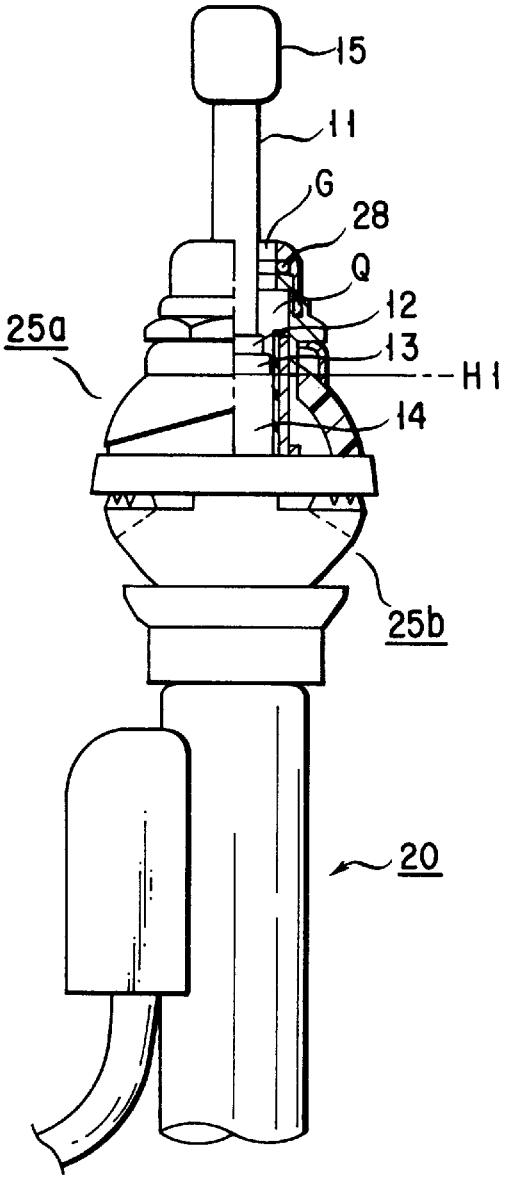
FIG. 17 is a view for explaining the demerits of the telescopic rod antenna apparatus according to the first embodiment of the present invention when the largest-diameter rod displacement means is removed from the apparatus.

FIG. 17 shows the drawback of a rod antenna apparatus which does not have a largest-diameter rod displacement means including the coil spring 24, as compared with the apparatus shown in FIG. 16.

If there are no means for displacing the largest-diameter rod 14 from the first state to the second state, a great gap G will occur between the inner surface of the opening of the holding tube 20 and the tip portion of the antenna element, which looks like a tier, as shown in FIG. 17, during a period of time (about 5.7 seconds when the element length is about 920 mm) from when the top portion 15 of the smallest-diameter rod 11 deviates from the position of the O-shaped ring 28 until the tip portion of the rod 14 arrives at the position of the O-shaped ring. Thus, rainwater or the like easily soaks into a space Q in the holding tube 20 through the gap G, resulting in various problems. In the first embodiment of the present invention, such problems hardly occur.

As described above, the telescopic rod antenna apparatus according to the first embodiment has an almost perfect waterproof means applied to each portion through which water is likely to enter the antenna apparatus. This waterproof means is summarized as follows:

(1) The top-portion buried type telescopic rod antenna apparatus is so devised that a gap G hardly occurs between the tip portion of the antenna element 10 and the opening portion of the holding tube 20 when the antenna element is extended and retracted.

(2) The antenna apparatus is so devised that a gap hardly occurs between the inner surface of the opening of the holding tube 20 and the largest-diameter portion (rod 14 and top portion 15) of the antenna element 10 inserted into the opening.

(3) A gap due to caulking does not occur between the smallest-diameter rod 11 and its subsequent rod 12 which constitute the antenna element 10.

(4) No water soaks through a joint between the smaller-diameter rod (Ra) and the larger-diameter rod (Rb).

According to the telescopic rod antenna apparatus of the first embodiment, a remarkably good waterproof effect can stably be maintained for a long time. The antenna element is unlikely to be frozen or damaged and thus can avoid increasing in load. As a result, the driving force for extending and retracting the antenna element 10 can be decreased and thus a small-sized, low-powered driving motor can be used, thereby decreasing an operation noise caused when the antenna element is extended or retracted. Since, moreover, the antenna apparatus is simple in construction, it can be manufactured at low cost.

Second Embodiment

Figure 18:
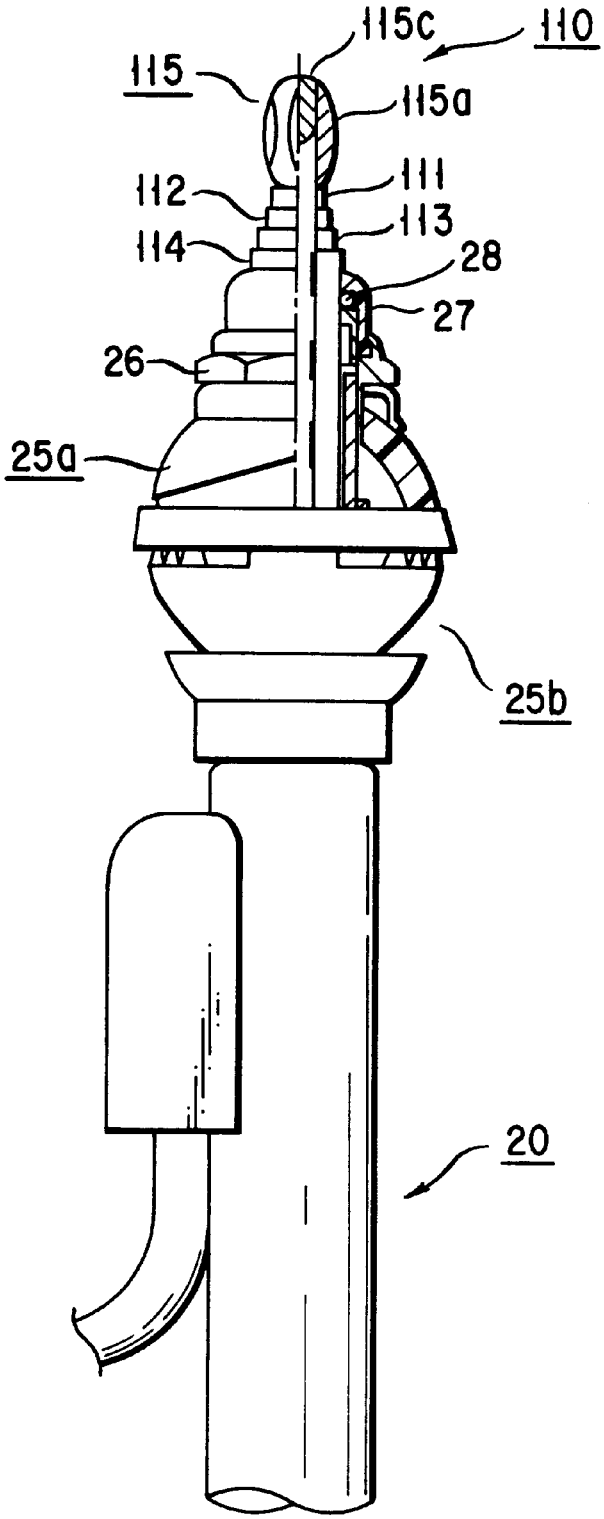
FIG. 18 is a schematic view showing the constitution of a telescopic rod antenna apparatus according to a second embodiment of the present invention.

FIG. 18 schematically shows a constitution of a telescopic rod antenna apparatus according to a second embodiment of the present invention. The second embodiment differs from the first embodiment in that the present invention is applied to a top-portion projected type telescopic rod antenna apparatus.

As shown in FIG. 18, an antenna element 110 of the antenna apparatus is constituted of plural rods 111 to 114 (four rods in this embodiment) having different diameters which are made of conductive tubes and slidably coupled to each other. Even when the antenna element 110 is completely held in a holding tube 20, a tip portion of the antenna element 110, which looks like a tier, is protruded outside the holding tube 20. Therefore, the antenna apparatus of the second embodiment excludes a largest-diameter rod displacement means corresponding to the coil spring 24 in the first embodiment.

An O-shaped ring 28, which is mounted on the inner surface of a cap 27, is brought into fluid-tight contact with the outer surface of the largest-diameter rod 114 of the antenna element 110 to prevent rainwater or the like from entering the apparatus from outside. An egg-shaped top portion 115, which is formed of a short cylinder member 115*a* and a stopper member 115*c* as in the first embodiment, is attached to the tip portion of the smallest-diameter rod 111. Though not shown, as in the first embodiment, a ring-shaped seal member made of thermoplastic resin is inserted into a ring-shaped gap of the antenna element.

In the second embodiment, too, substantially the same advantage as those of the first embodiment can be expected, except for the advantage of the largest-diameter rod displacement means.

Experiments

A waterproof test was carried out for experimental products X1 to X3 having the same constitution as the telescopic rod antenna apparatus of the first embodiment, experimental products Y1 to Y3 having the same constitution as the telescopic rod antenna apparatus of the second embodiment, and conventional products Z1 to Z3. The following results were obtained. In the experimental products X1 to X3 and Y1 to Y3, the ring-shaped seal member of thermoplastic resin, inserted into the ring-shaped gap in a joint of rods of the antenna element, corresponds to each of the improved ones as shown in FIGS. 7 to 10.

Conditions of Experiments

Shower:

Hydraulic Pressure . . . 1 kg/cm$^2$

Time . . . 1 Hr

Extending/retracting Operation:

Once per minute (extension 7 to 8 seconds, pause 2 to 3 seconds, retraction 7 to 8 seconds)

Method of Measurement:

Water drained from the lower end portion of the holding tube 20 is collected and its weight is measured.

Results of Measurements

| | | |
|---|---|---|
| X1 = 0 g | Y1 = 0 g | Z1 = 18.9 g |
| X2 = 0 g | Y2 = 0 g | Z2 = 23.9 g |
| X3 = 0 g | Y3 = 0 g | Z3 = 11.2 g |

Evaluation

In the experimental products X1 to X3 and the experimental products Y1 to Y3, the amounts of water soaking in the antenna apparatus are zero. Thus, the effectiveness of the waterproof means of the embodiments of the present invention was proved definitely.

Summary of the Embodiments

[1] A telescopic rod antenna apparatus, as described in the embodiments of the present invention, is characterized by comprising:

an antenna element 10 constituted by slidably coupling a plurality of rods 11 to 14 to each other, the rods 11 to 14 being formed of conductive tube members having different diameters;

a holding tube 20 into which the antenna element 10 is held insertably;

an extending/retracting mechanism 30 for extending the antenna element 10 by projecting the smallest-diameter rod 11 of the antenna element 10 outside another rod and retracting the antenna element 10 by pulling the smallest-diameter rod 11 into another rod;

displacement means 23, 24 for displacing the largest-diameter rod 14 outside the holding tube 20 when the antenna element 10 starts to be extended by the extending/retracting mechanism 30 to shift the rods from a first state in which a top portion 15 attached to the tip portion of the smallest-diameter rod 11 is located in an opening of the holding tube 20 to a second shift in which a tip portion of the largest-diameter rod 14 is located in the opening of the holding tube 20;

extension means 33, 34, 35, . . . for, after the rods are shifted to the second state by the displacement means 23, 24, extending the antenna element 10 using the extending/retracting mechanism 30 to project each of the rods 11 to 14 outside the largest-diameter rod 14;

retraction means 33, 34, 35, . . . for retracting the antenna element 10 using the extending/retraction mechanism 30 to pull each of the rods 11 to 13 into the largest-diameter rod 14 and set the largest-diameter rod 14 in the second state; and means for, after the antenna element 10 is retracted by the retraction means 33, 34, 35, . . . , pulling the largest-diameter rod 14 into the initial position of the holding tube 20 when the antenna element 10 ends the retraction operation performed by the extending/retracting mechanism 30 and set the antenna element 10 to the first state.

[2] The telescopic rod antenna apparatus according to item [1] is characterized in that the displacement means includes a spring member (e.g., a coil spring, plate spring, and a cylindrical bellows made of metal, resin, rubber or the like) which is so fitted into the holding tube 20 such that the largest-diameter rod 14 is displaced outside the holding tube 20.

[3] The telescopic rod antenna apparatus according to item [2] characterized in that the spring member is a coil spring 23 compressed between the bottom portion of the holding tube 20 and the distal end of the largest-diameter rod 14.

[4] The telescopic rod antenna apparatus according to item [1] is characterized in that the extending/retracting mechanism 30 includes a driving motor 33, a rope transfer mechanism rotated by the driving motor 33, and a rope 34 transferred by the rope transfer mechanism in the longitudinal direction, and moves the smallest-diameter rod 11 in the longitudinal direction thereof at the tip of the rope 34.

[5] The telescopic rod antenna apparatus according to item [1] is characterized in that the antenna element 10 is formed so as to prevent water from soaking therein from outside by sealing a ring-shaped gap in a joint between the outer surface of the smaller-diameter rod Ra and the inner surface of the larger-diameter rod Rb fluid-tightly by a ring-shaped seal member 16 which is formed of a film strip of thermoplastic resin inserted into a ring-shaped gap in a joint between the smaller-diameter rod Ra and the larger-diameter rod Rb.

[6] A telescopic rod antenna apparatus, as described in the embodiments of the present invention, is characterized by comprising:

an antenna element 10 constituted by slidably coupling a plurality of rods 11 to 14 to each other, the rods 11 to 14 being formed of conductive tube members having different diameters;

a holding tube 20 into which the antenna element 10 is held insertably;

O-shaped ring seal means 26, 27, 28 attached to an opening of the holding tube 20 so as to contact the largest-diameter portion 14 or 15 of the antenna element 10 fluid-tightly;

an extending/retracting mechanism 30 for extending the antenna element 10 by projecting the smallest-diameter rod 11 of the antenna element 10 outside another rod and retracting the antenna element 10 by pulling the smallest-diameter rod 11 into another rod;

displacement means 23, 24 for displacing the largest-diameter rod 14 outside the holding tube 20 when the antenna element 10 starts to be extended by the extending/retracting mechanism 30 to shift the rods from a first state in which a top portion 15 attached to the tip portion of the smallest-diameter rod 11 is located in an opening of the holding tube 20 to a second shift in which a tip portion of the largest-diameter rod 14 is located in the opening of the holding tube 20;

extension means 33, 34, 35, . . . for, after the rods are shifted to the second state by the displacement means 23, 24, extending the antenna element 10 using the extending/retracting mechanism 30 to project each of the rods 11 to 14 outside the largest-diameter rod 14;

retraction means 33, 34, 35, . . . for retracting the antenna element 10 using the extending/retraction mechanism 30 to pull each of the rods 11 to 13 into the largest-diameter rod 14 and set the largest-diameter rod 14 in the second state; and means for, after the antenna element 10 is retracted by the retraction means 33, 34, 35, . . . , pulling the largest-diameter rod 14 into the initial position of the holding tube 20 when the antenna element 10 ends the retraction operation performed by the extending/retracting mechanism 30 and set the antenna element 10 to the first state.

[7] The telescopic rod antenna apparatus according to item [6] is characterized in that the O-shaped ring seal means 26, 27, 28 includes an O-shaped ring 28 provided in a recess R formed between a fixed nut 26 for fixing the holding tube 20 to an object for mounting the antenna apparatus and a cap 27 covering the fixed nut 26.

[8] The telescopic rod antenna apparatus according to item [7] is characterized in that the fixed nut 26 and the cap 27 are coupled integrally with each other as one component by caulking part of the fixed nut 26 with a distal end of the cap 27.

[9] A telescopic rod antenna apparatus, as described in the embodiments of the present invention, is characterized by comprising:

an antenna element 10 constituted by slidably coupling a plurality of rods 11 to 14 to each other, the rods 11 to 14 being formed of conductive tube members having different diameters;

a top portion 15 provided at a tip portion of the smallest-diameter rod 11 of the antenna element 10, and including a short cylinder member 15*a* fixed onto the outer surface of a smaller-diameter portion of the tip portion of the smallest-diameter rod 11 and a stopper member 15*c* inserted and fixed into the smallest-diameter rod 11 such that an opening end 15*b* of the short cylinder member 15*a* is sealed at the tip portion of the smallest-diameter rod 11;

a holding tube 20 into which the antenna element 10 is held insertably;

an extending/retracting mechanism 30 for extending the antenna element 10 by projecting the smallest-diameter rod 11 of the antenna element 10 outside another rod and retracting the antenna element 10 by pulling the smallest-diameter rod 11 into another rod;

displacement means 23, 24 for displacing the largest-diameter rod 14 outside the holding tube 20 when the antenna element 10 starts to be extended by the extending/retracting mechanism 30 to shift the rods from a first state in which a top portion 15 attached to the tip portion of the smallest-diameter rod 11 is located in an opening of the holding tube 20 to a second shift in which a tip portion of the largest-diameter rod 14 is located in the opening of the holding tube 20;

extension means 33, 34, 35, . . . for, after the rods are shifted to the second state by the displacement means 23, 24, extending the antenna element 10 using the extending/retracting mechanism 30 to project each of the rods 11 to 14 outside the largest-diameter rod 14;

retraction means 33, 34, 35, . . . for retracting the antenna element 10 using the extending/retraction mechanism 30 to pull each of the rods 11 to 13 into the largest-diameter rod 14 and set the largest-diameter rod 14 in the second state; and means for, after the antenna element 10 is retracted by the retraction means 33, 34, 35, . . . , pulling the largest-diameter rod 14 into the initial position of the holding tube 20 when the antenna element 10 ends the retraction operation performed by the extending/retracting mechanism 30 and set the antenna element 10 to the first state.

[10] The telescopic rod antenna apparatus according to item [9] is characterized in that the stopper member 15*c* of the top portion 15 is made of resin and compressed and inserted into the smallest-diameter rod 11 so as to seal the opening end 15*b* of the short cylinder member 15*a* fluid-tightly.

[11] A telescopic rod antenna apparatus, as described in the embodiments of the present invention, is characterized by comprising:

an antenna element 10 constituted by slidably coupling a plurality of rods 11 to 14 to each other, the rods 11 to 14 being formed of conductive tube members having different diameters;

a ring-shaped seal member 40 constituted by rolling a film strip 41, which is made of thermoplastic resin and has one or plural projecting portions 42 in a longitudinal direction, like a ring and then compressing and inserting the rolled film strip 41 into a ring-shaped gap in a joint between a smaller-diameter rod Ra and a larger-diameter rod Rb, the ring-shaped seal member 40 being provided for fluid-tightly sealing a gap between the outer surface of the smaller-diameter rod Ra and the inner surface of the larger-diameter rod Rb by adhering a plurality of ring-shaped contact portions A to E, which are formed along a longitudinal direction on both sides of the film strip 41 when the one or plural projecting portions 42 serve as basic contact portions, to the inner surface of the larger-diameter rod Rb and the outer surface of the smaller-diameter rod Ra at a predetermined pressure;

a holding tube 20 into which the antenna element 10 is held insertably;

an extending/retracting mechanism 30 for extending the antenna element 10 by projecting the smallest-diameter rod 11 of the antenna element 10 outside another rod and retracting the antenna element 10 by pulling the smallest-diameter rod 11 into another rod;

displacement means 23, 24 for displacing the largest-diameter rod 14 outside the holding tube 20 when the antenna element 10 starts to be extended by the extending/retracting mechanism 30 to shift the rods from a first state in which a top portion 15 attached to the tip portion of the smallest-diameter rod 11 is located in an opening of the holding tube 20 to a second shift in which a tip portion of the largest-diameter rod 14 is located in the opening of the holding tube 20;

extension means 33, 34, 35, . . . for, after the rods are shifted to the second state by the displacement means 23, 24, extending the antenna element 10 using the extending/retracting mechanism 30 to project each of the rods 11 to 14 outside the largest-diameter rod 14;

retraction means 33, 34, 35, . . . for retracting the antenna element 10 using the extending/retraction mechanism 30 to pull each of the rods 11 to 13 into the largest-diameter rod 14 and set the largest-diameter rod 14 in the second state; and means for, after the antenna element 10 is retracted by the retraction means 33, 34, 35, . . . , pulling the largest-diameter rod 14 into the initial position of the holding tube 20 when the antenna element 10 ends the retraction operation performed by the extending/retracting mechanism 30 and set the antenna element 10 to the first state.

[12] The telescopic rod antenna apparatus according to item [11] is characterized in that the film strip 41 is formed of ethylene tetrafluoride resin which is one type of thermoplastic resin.

[13] The telescopic rod antenna apparatus according to item [11] is characterized in that the ring-shaped seal member 40 is inserted into the ring-shaped gap in such a manner that the projecting portion 42 formed along the centerline on the film strip 41 in the longitudinal direction is brought into contact with the outer surface of the smaller-diameter rod Ra.

[14] A telescopic rod antenna apparatus, as described in the embodiments of the present invention, is characterized by comprising:

an antenna element 10 constituted by slidably coupling a plurality of rods 11 to 14 to each other, the rods 11 to 14 being formed of conductive tube members having different diameters;

a top portion 15 provided at a tip portion of the smallest-diameter rod 11 of the antenna element 10, and including a short cylinder member 15*a* fixed onto the outer surface of a smaller-diameter portion of the tip portion of the smallest-diameter rod 11 and a stopper member 15*c* inserted and fixed into the smallest-diameter rod 11 such that an opening end 15*b* of the short cylinder member 15*a* is sealed at the tip portion of the smallest-diameter rod 11;

a ring-shaped seal member 40 constituted by rolling a film strip 41, which is made of thermoplastic resin and has one or plural projecting portions 42 in a longitudinal direction, like a ring and then compressing and inserting the rolled film strip 41 into a ring-shaped gap in a joint between a smaller-diameter rod Ra and a larger-diameter rod Rb, the ring-shaped seal member 40 being provided for fluid-tightly sealing a gap between the outer surface of the smaller-diameter rod Ra and the inner surface of the larger-diameter rod Rb by adhering a plurality of ring-shaped contact portions A to E, which are formed along a longitudinal direction on both sides of the film strip 41 when the one or plural projecting portions 42 serve as basic contact portions, to the inner surface of the larger-diameter rod Rb and the outer surface of the smaller-diameter rod Ra at a predetermined pressure;

a holding tube 20 into which the antenna element 10 is held insertably;

an extending/retracting mechanism 30 for extending the antenna element 10 by projecting the smallest-diameter rod 11 of the antenna element 10 outside another rod and retracting the antenna element 10 by pulling the smallest-diameter rod 11 into another rod;

displacement means 23, 24 for displacing the largest-diameter rod 14 outside the holding tube 20 when the antenna element 10 starts to be extended by the extending/retracting mechanism 30 to shift the rods from a first state in which a top portion 15 attached to the tip portion of the smallest-diameter rod 11 is located in an opening of the holding tube 20 to a second shift in which a tip portion of the largest-diameter rod 14 is located in the opening of the holding tube 20;

extension means 33, 34, 35, . . . for, after the rods are shifted to the second state by the displacement means 23, 24, extending the antenna element 10 using the extending/retracting mechanism 30 to project each of the rods 11 to 14 outside the largest-diameter rod 14;

retraction means 33, 34, 35, . . . for retracting the antenna element 10 using the extending/retraction mechanism 30 to pull each of the rods 11 to 13 into the largest-diameter rod 14 and set the largest-diameter rod 14 in the second state; and means for, after the antenna element 10 is retracted by the retraction means 33, 34, 35, . . . , pulling the largest-diameter rod 14 into the initial position of the holding tube 20 when the antenna element 10 ends the retraction operation performed by the extending/retracting mechanism 30 and set the antenna element 10 to the first state.

[15] A telescopic rod antenna apparatus, as described in the embodiments of the present invention, is characterized by comprising:

an antenna element 10 constituted by slidably coupling a plurality of rods 11 to 14 to each other, the rods 11 to 14 being formed of conductive tube members having different diameters;

a top portion 15 provided at a tip portion of the smallest-diameter rod 11 of the antenna element 10, and including a short cylinder member 15*a* fixed onto the outer surface of a smaller-diameter portion of the tip portion of the smallest-diameter rod 11 and a stopper member 15*c* inserted and fixed into the smallest-diameter rod 11 such that an opening end 15*b* of the short cylinder member 15*a* is sealed at the tip portion of the smallest-diameter rod 11;

a holding tube 20 into which the antenna element 10 is held insertably;

O-shaped ring seal means 26, 27, 28 attached to an opening of the holding tube 20 so as to contact the largest-diameter portion 14 or 15 of the antenna element 10 fluid-tightly;

an extending/retracting mechanism 30 for extending the antenna element 10 by projecting the smallest-diameter rod 11 of the antenna element 10 outside another rod and retracting the antenna element 10 by pulling the smallest-diameter rod 11 into another rod;

displacement means 23, 24 for displacing the largest-diameter rod 14 outside the holding tube 20 when the antenna element 10 starts to be extended by the extending/retracting mechanism 30 to shift the rods from a first state in which a top portion 15 attached to the tip portion of the smallest-diameter rod 11 is located in the opening of the holding tube 20 to a second shift in which a tip portion of the largest-diameter rod 14 is located in the opening of the holding tube 20;

extension means 33, 34, 35, . . . for, after the rods are shifted to the second state by the displacement means 23, 24, extending the antenna element 10 using the extending/retracting mechanism 30 to project each of the rods 11 to 14 outside the largest-diameter rod 14;

retraction means 33, 34, 35, . . . for retracting the antenna element 10 using the extending/retraction mechanism 30 to pull each of the rods 11 to 13 into the largest-diameter rod 14 and set the largest-diameter rod 14 in the second state; and means for, after the antenna element 10 is retracted by the retraction means 33, 34, 35, . . . , pulling the largest-diameter rod 14 into the initial position of the holding tube 20 when the antenna element 10 ends the retraction operation performed by the extending/retracting mechanism 30 and set the antenna element 10 to the first state.

[16] A telescopic rod antenna apparatus, as described in the embodiments of the present invention, is characterized by comprising:

an antenna element 10 constituted by slidably coupling a plurality of rods 11 to 14 to each other, the rods 11 to 14 being formed of conductive tube members having different diameters;

a ring-shaped seal member 40 constituted by rolling a film strip 41, which is made of thermoplastic resin and has one or plural projecting portions 42 in a longitudinal direction, like a ring and then compressing and inserting the rolled film strip 41 into a ring-shaped gap in a joint between a smaller-diameter rod Ra and a larger-diameter rod Rb, the ring-shaped seal member 40 being provided for fluid-tightly sealing a gap between the outer surface of the smaller-diameter rod Ra and the inner surface of the larger-diameter rod Rb by adhering a plurality of ring-shaped contact portions A to E, which are formed along a longitudinal direction on both sides of the film strip 41 when the one or plural projecting portions 42 serve as basic contact portions, to the larger-diameter rod Rb and the outer surface of the smaller-diameter rod Ra at a predetermined pressure;

a holding tube 20 into which the antenna element 10 is held insertably;

O-shaped ring seal means 26, 27, 28 attached to an opening of the holding tube 20 so as to contact the largest-diameter portion 14 or 15 of the antenna element 10 fluid-tightly;

an extending/retracting mechanism 30 for extending the antenna element 10 by projecting the smallest-diameter rod 11 of the antenna element 10 outside another rod and retracting the antenna element 10 by pulling the smallest-diameter rod 11 into another rod;

displacement means 23, 24 for displacing the largest-diameter rod 14 outside the holding tube 20 when the antenna element 10 starts to be extended by the extending/retracting mechanism 30 to shift the rods from a first state in which a top portion 15 attached to the tip portion of the smallest-diameter rod 11 is located in an opening of the holding tube 20 to a second shift in which a tip portion of the largest-diameter rod 14 is located in the opening of the holding tube 20;

extension means 33, 34, 35, . . . for, after the rods are shifted to the second state by the displacement means 23, 24, extending the antenna element 10 using the extending/retracting mechanism 30 to project each of the rods 11 to 14 outside the largest-diameter rod 14;

retraction means 33, 34, 35, . . . for retracting the antenna element 10 using the extending/retraction mechanism 30 to pull each of the rods 11 to 13 into the largest-diameter rod 14 and set the largest-diameter rod 14 in the second state; and means for, after the antenna element 10 is retracted by the retraction means 33, 34, 35, . . . , pulling the largest-diameter rod 14 into the initial position of the holding tube 20 when the antenna element 10 ends the retraction operation performed by the extending/retracting mechanism 30 and set the antenna element 10 to the first state.

[17] A telescopic rod antenna apparatus, as described in the embodiments of the present invention, is characterized by comprising:

an antenna element 10 constituted by slidably coupling a plurality of rods 11 to 14 to each other, the rods 11 to 14 being formed of conductive tube members having different diameters;

a top portion 15 provided at a tip portion of the smallest-diameter rod 11 of the antenna element 10, and including a short cylinder member 15*a* fixed onto the outer surface of a smaller-diameter portion of the tip portion of the smallest-diameter rod 11 and a stopper member 15*c* inserted and fixed into the smallest-diameter rod 11 such that an opening end 15*b* of the short cylinder member 15*a* is sealed at the tip portion of the smallest-diameter rod 11;

a ring-shaped seal member 40 constituted by rolling a film strip 41, which is made of thermoplastic resin and has one or plural projecting portions 42 in a longitudinal direction, like a ring and then compressing and inserting the rolled film strip 41 into a ring-shaped gap in a joint between a smaller-diameter rod Ra and a larger-diameter rod Rb, the ring-shaped seal member 40 being provided for fluid-tightly sealing a gap between the outer surface of the smaller-diameter rod Ra and the inner surface of the larger-diameter rod Rb by adhering a plurality of ring-shaped contact portions A to E, which are formed along a longitudinal direction on both sides of the film strip 41 when the one or plural projecting portions 42 serve as basic contact portions, to the larger-diameter rod Rb and the outer surface of the smaller-diameter rod Ra at a predetermined pressure;

a holding tube 20 into which the antenna element 10 is held insertably;

O-shaped ring seal means 26, 27, 28 attached to an opening of the holding tube 20 so as to contact the largest-diameter portion 14 or 15 of the antenna element 10 fluid-tightly;

an extending/retracting mechanism 30 for extending the antenna element 10 by projecting the smallest-diameter rod 11 of the antenna element 10 outside another rod and retracting the antenna element 10 by pulling the smallest-diameter rod 11 into another rod;

displacement means 23, 24 for displacing the largest-diameter rod 14 outside the holding tube 20 when the antenna element 10 starts to be extended by the extending/retracting mechanism 30 to shift the rods from a first state in which a top portion 15 attached to the tip portion of the smallest-diameter rod 11 is located in an opening of the holding tube 20 to a second shift in which a tip portion of the largest-diameter rod 14 is located in the opening of the holding tube 20;

extension means 33, 34, 35, . . . for, after the rods are shifted to the second state by the displacement means 23, 24, extending the antenna element 10 using the extending/retracting mechanism 30 to project each of the rods 11 to 14 outside the largest-diameter rod 14;

retraction means 33, 34, 35, . . . for retracting the antenna element 10 using the extending/retraction mechanism 30 to pull each of the rods 11 to 13 into the largest-diameter rod 14 and set the largest-diameter rod 14 in the second state; and means for, after the antenna element 10 is retracted by the retraction means 33, 34, 35, . . . , pulling the largest-diameter rod 14 into the initial position of the holding tube 20 when the antenna element 10 ends the retraction operation performed by the extending/retracting mechanism 30 and set the antenna element 10 to the first state.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A telescopic rod antenna apparatus comprising:

an antenna element constituted by slidably coupling a plurality of rods to each other, the rods being formed of conductive tube members having different diameters;

a holding tube into which the antenna element is held insertably;

an extending/retracting mechanism for extending the antenna element by projecting a smallest-diameter rod of the antenna element outside another rod and retracting the antenna element by pulling the smallest-diameter rod into another rod;

displacement means for displacing a largest-diameter rod outside the holding tube when the antenna element starts to be extended by the extending/retracting mechanism to shift the rods from a first state in which a top portion attached to a tip portion of the smallest-diameter rod is located in an opening of the holding tube to a second shift in which a tip portion of the largest-diameter rod is located in the opening of the holding tube;

extension means for, after the rods are shifted to the second state by the displacement means, extending the antenna element using the extending/retracting mechanism to project each of the rods outside the largest-diameter rod;

retraction means for retracting the antenna element using the extending/retraction mechanism to pull each of the rods into the largest-diameter rod and set the largest-diameter rod in the second state; and means for, after the antenna element is retracted by the retraction means, pulling the largest-diameter rod into an initial position of the holding tube when the antenna element ends the retraction operation performed by the extending/retracting mechanism and set the antenna element to the first state.

2. The telescopic rod antenna apparatus according to claim 1, wherein the displacement means includes a spring member which is so fitted into the holding tube such that the largest-diameter rod is displaced outside the holding tube.

3. The telescopic rod antenna apparatus according to claim 2, wherein the spring member is a coil spring compressed between a bottom portion of the holding tube and a distal end of the largest-diameter rod.

4. The telescopic rod antenna apparatus according to claim 1, wherein the extending/retracting mechanism includes a driving motor, a rope transfer mechanism rotated by the driving motor, and a rope transferred by the rope transfer mechanism in the longitudinal direction, and moves the smallest-diameter rod in the longitudinal direction thereof at a tip of the rope.

5. The telescopic rod antenna apparatus according to claim 1, wherein the antenna element is formed so as to prevent water from soaking therein from outside by sealing a ring-shaped gap in a joint between the outer surface of a smaller-diameter rod and the inner surface of a larger-diameter rod fluid-tightly by a ring-shaped seal member which is formed of a film strip of thermoplastic resin inserted into a ring-shaped gap in a joint between the smaller-diameter rod and the larger-diameter rod.

6. A telescopic rod antenna apparatus comprising:

an antenna element constituted by slidably coupling a plurality of rods to each other, the rods being formed of conductive tube members having different diameters;

a holding tube into which the antenna element is held insertably;

O-shaped ring seal means attached to an opening of the holding tube so as to contact a largest-diameter portion of the antenna element fluid-tightly;

an extending/retracting mechanism for extending the antenna element by projecting a smallest-diameter rod of the antenna element outside another rod and retracting the antenna element by pulling the smallest-diameter rod into another rod;

displacement means for displacing a largest-diameter rod outside the holding tube when the antenna element starts to be extended by the extending/retracting mechanism to shift the rods from a first state in which a top portion attached to the tip portion of the smallest-diameter rod is located in an opening of the holding tube to a second shift in which a tip portion of the largest-diameter rod is located in the opening of the holding tube;

extension means for, after the rods are shifted to the second state by the displacement means extending the antenna element using the extending/retracting mechanism to project each of the rods outside the largest-diameter rod;

retraction means for retracting the antenna element using the extending/retraction mechanism to pull each of the rods into the largest-diameter rod and set the largest-diameter rod in the second state; and means for, after the antenna element is retracted by the retraction means, pulling the largest-diameter rod into an initial position of the holding tube when the antenna element ends the retraction operation performed by the extending/retracting mechanism and set the antenna element to the first state.

7. The telescopic rod antenna apparatus according to claim 6, wherein the O-shaped ring seal means includes an O-shaped ring provided in a recess formed between a fixed nut for fixing the holding tube to an object for mounting the antenna apparatus and a cap covering the fixed nut.

8. The telescopic rod antenna apparatus according to claim 7, wherein the fixed nut and the cap are coupled integrally with each other as one component by caulking part of the fixed nut with a distal end of the cap.

9. A telescopic rod antenna apparatus, as described in the embodiments of the present invention, is characterized by comprising:

an antenna element constituted by slidably coupling a plurality of rods to each other, the rods being formed of conductive tube members having different diameters;

a top portion provided at a tip portion of a smallest-diameter rod of the antenna element and including a short cylinder member fixed onto the outer surface of a smaller-diameter portion of the tip portion of the smallest-diameter rod and a stopper member inserted and fixed into the smallest-diameter rod such that an opening end of the short cylinder member is sealed at the tip portion of the smallest-diameter rod;

a holding tube into which the antenna element is held insertably;

an extending/retracting mechanism for extending the antenna element by projecting the smallest-diameter rod of the antenna element outside another rod and retracting the antenna element by pulling the smallest-diameter rod into another rod;

displacement means for displacing the largest-diameter rod outside the holding tube when the antenna element starts to be extended by the extending/retracting mechanism to shift the rods from a first state in which a top portion attached to the tip portion of the smallest-diameter rod is located in an opening of the holding tube to a second shift in which a tip portion of the largest-diameter rod is located in the opening of the holding tube;

extension means for, after the rods are shifted to the second state by the displacement means, extending the antenna element using the extending/retracting mechanism to project each of the rods outside the largest-diameter rod;

retraction means for retracting the antenna element using the extending/retraction mechanism to pull each of the rods into the largest-diameter rod and set the largest-diameter rod in the second state; and means for, after the antenna element is retracted by the retraction means pulling the largest-diameter rod into an initial position of the holding tube when the antenna element ends the retraction operation performed by the extending/retracting mechanism and set the antenna element to the first state.

10. The telescopic rod antenna apparatus according to claim 9, wherein the stopper member of the top portion is made of resin and compressed and inserted into the smallest-diameter rod so as to seal the opening end of the short cylinder member fluid-tightly.

11. A telescopic rod antenna apparatus comprising:

an antenna element constituted by slidably coupling a plurality of rods to each other, the rods being formed of conductive tube members having different diameters;

a ring-shaped seal member constituted by rolling a film strip, which is made of thermoplastic resin and has one or plural projecting portions in a longitudinal direction, like a ring and then compressing and inserting the rolled film strip into a ring-shaped gap in a joint between a smaller-diameter rod and a larger-diameter rod, the ring-shaped seal member being provided for fluid-tightly sealing a gap between the outer surface of the smaller-diameter rod and the inner surface of the larger-diameter rod by adhering a plurality of ring-shaped contact portions, which are formed along a longitudinal direction on both sides of the film strip when the one or plural projecting portions serve as basic contact portions, to the inner surface of the larger-diameter rod and the outer surface of the smaller-diameter rod at a predetermined pressure;

a holding tube into which the antenna element is held insertably;

an extending/retracting mechanism for extending the antenna element by projecting the smallest-diameter rod of the antenna element outside another rod and retracting the antenna element by pulling the smallest-diameter rod into another rod;

displacement means for displacing the largest-diameter rod outside the holding tube when the antenna element starts to be extended by the extending/retracting mechanism to shift the rods from a first state in which a top portion attached to the tip portion of the smallest-diameter rod is located in an opening of the holding tube to a second shift in which a tip portion of the largest-diameter rod is located in the opening of the holding tube;

extension means for, after the rods are shifted to the second state by the displacement means extending the antenna element using the extending/retracting mechanism to project each of the rods outside the largest-diameter rod;

retraction means for retracting the antenna element using the extending/retraction mechanism to pull each of the rods into the largest-diameter rod and set the largest-diameter rod in the second state; and means for, after the antenna element is retracted by the retraction means, pulling the largest-diameter rod into an initial position of the holding tube when the antenna element ends the retraction operation performed by the extending/retracting mechanism and set the antenna element to the first state.

12. The telescopic rod antenna apparatus according to claim 11, wherein the film strip is formed of ethylene tetrafluoride resin which is one type of thermoplastic resin.

13. The telescopic rod antenna apparatus according to claim 11, wherein the ring-shaped seal member is inserted into the ring-shaped gap in such a manner that the projecting portion formed along a centerline on the film strip in the longitudinal direction is brought into contact with the outer surface of the smaller-diameter rod.

14. A telescopic rod antenna apparatus comprising:

an antenna element constituted by slidably coupling a plurality of rods to each other, the rods being formed of conductive tube members having different diameters;

a top portion provided at a tip portion of the smallest-diameter rod of the antenna element and including a short cylinder member fixed onto the outer surface of a smaller-diameter portion of the tip portion of the smallest-diameter rod and a stopper member inserted and fixed into the smallest-diameter rod such that an opening end of the short cylinder member is sealed at the tip portion of the smallest-diameter rod;

a ring-shaped seal member constituted by rolling a film strip, which is made of thermoplastic resin and has one or plural projecting portions in a longitudinal direction, like a ring and then compressing and inserting the rolled film strip into a ring-shaped gap in a joint between a smaller-diameter rod and a larger-diameter rod, the ring-shaped seal member being provided for fluid-tightly sealing a gap between the outer surface of the smaller-diameter rod and the inner surface of the larger-diameter rod by adhering a plurality of ring-shaped contact portions A to E, which are formed along a longitudinal direction on both sides of the film strip when the one or plural projecting portions serve as basic contact portions, to the inner surface of the larger-diameter rod and the outer surface of the smaller-diameter rod at a predetermined pressure;

a holding tube into which the antenna element is held insertably;

an extending/retracting mechanism for extending the antenna element by projecting the smallest-diameter rod of the antenna element outside another rod and retracting the antenna element by pulling the smallest-diameter rod into another rod;

displacement means for displacing the largest-diameter rod outside the holding tube when the antenna element starts to be extended by the extending/retracting mechanism to shift the rods from a first state in which a top portion attached to the tip portion of the smallest-diameter rod is located in an opening of the holding tube to a second shift in which a tip portion of the largest-diameter rod is located in the opening of the holding tube;

extension means for, after the rods are shifted to the second state by the displacement means, extending the antenna element using the extending/retracting mechanism to project each of the rods outside the largest-diameter rod;

retraction means for retracting the antenna element using the extending/retraction mechanism to pull each of the rods into the largest-diameter rod and set the largest-diameter rod in the second state; and means for, after the antenna element is retracted by the retraction means, pulling the largest-diameter rod into an initial position of the holding tube when the antenna element ends the retraction operation performed by the extending/retracting mechanism and set the antenna element to the first state.

15. A telescopic rod antenna apparatus comprising:

an antenna element constituted by slidably coupling a plurality of rods to each other, the rods being formed of conductive tube members having different diameters;

a top portion provided at a tip portion of the smallest-diameter rod of the antenna element, and including a short cylinder member fixed onto the outer surface of a smaller-diameter portion of the tip portion of the smallest-diameter rod and a stopper member inserted and fixed into the smallest-diameter rod such that an opening end of the short cylinder member is sealed at the tip portion of the smallest-diameter rod;

a holding tube into which the antenna element is held insertably;

O-shaped ring seal means attached to an opening of the holding tube so as to contact the largest-diameter portion of the antenna element fluid-tightly;

an extending/retracting mechanism for extending the antenna element by projecting the smallest-diameter rod of the antenna element outside another rod and retracting the antenna element by pulling the smallest-diameter rod into another rod;

displacement means for displacing the largest-diameter rod outside the holding tube when the antenna element starts to be extended by the extending/retracting mechanism to shift the rods from a first state in which a top portion attached to the tip portion of the smallest-diameter rod is located in the opening of the holding tube to a second shift in which a tip portion of the largest-diameter rod is located in the opening of the holding tube;

extension means for, after the rods are shifted to the second state by the displacement means, extending the antenna element using the extending/retracting mechanism to project each of the rods outside the largest-diameter rod;

retraction means for retracting the antenna element using the extending/retraction mechanism to pull each of the rods into the largest-diameter rod and set the largest-diameter rod in the second state; and means for, after the antenna element is retracted by the retraction means, pulling the largest-diameter rod into an initial position of the holding tube when the antenna element ends the retraction operation performed by the extending/retracting mechanism and set the antenna element to the first state.

16. A telescopic rod antenna apparatus comprising:

an antenna element constituted by slidably coupling a plurality of rods to each other, the rods being formed of conductive tube members having different diameters;

a ring-shaped seal member constituted by rolling a film strip, which is made of thermoplastic resin and has one or plural projecting portions in a longitudinal direction, like a ring and then compressing and inserting the rolled film strip into a ring-shaped gap in a joint between a smaller-diameter rod and a larger-diameter rod, the ring-shaped seal member being provided for fluid-tightly sealing a gap between the outer surface of the smaller-diameter rod and the inner surface of the larger-diameter rod by adhering a plurality of ring-shaped contact portions, which are formed along a longitudinal direction on both sides of the film strip when the one or plural projecting portions serve as basic contact portions, to the larger-diameter rod and the outer surface of the smaller-diameter rod at a predetermined pressure;

a holding tube into which the antenna element is held insertably;

O-shaped ring seal means attached to an opening of the holding tube so as to contact the largest-diameter portion of the antenna element fluid-tightly;

an extending/retracting mechanism for extending the antenna element by projecting the smallest-diameter rod of the antenna element outside another rod and retracting the antenna element by pulling the smallest-diameter rod into another rod;

displacement means for displacing the largest-diameter rod outside the holding tube when the antenna element starts to be extended by the extending/retracting mechanism to shift the rods from a first state in which a top portion attached to the tip portion of the smallest-diameter rod is located in an opening of the holding tube to a second shift in which a tip portion of the largest-diameter rod is located in the opening of the holding tube;

extension means for, after the rods are shifted to the second state by the displacement means, extending the antenna element using the extending/retracting mechanism to project each of the rods outside the largest-diameter rod;

retraction means for retracting the antenna element using the extending/retraction mechanism to pull each of the rods into the largest-diameter rod and set the largest-diameter rod in the second state; and means for, after the antenna element is retracted by the retraction means, pulling the largest-diameter rod into an initial position of the holding tube when the antenna element ends the retraction operation performed by the extending/retracting mechanism and set the antenna element to the first state.

17. A telescopic rod antenna apparatus comprising:

an antenna element constituted by slidably coupling a plurality of rods to each other, the rods being formed of conductive tube members having different diameters;

a top portion provided at a tip portion of the smallest-diameter rod of the antenna element, and including a short cylinder member fixed onto the outer surface of a smaller-diameter portion of the tip portion of the smallest-diameter rod and a stopper member inserted and fixed into the smallest-diameter rod such that an opening end of the short cylinder member is sealed at the tip portion of the smallest-diameter rod;

a ring-shaped seal member constituted by rolling a film strip, which is made of thermoplastic resin and has one or plural projecting portions in a longitudinal direction, like a ring and then compressing and inserting the rolled film strip into a ring-shaped gap in a joint between a smaller-diameter rod and a larger-diameter rod, the ring-shaped seal member being provided for fluid-tightly sealing a gap between the outer surface of the smaller-diameter rod and the inner surface of the larger-diameter rod by adhering a plurality of ring-shaped contact portions, which are formed along a longitudinal direction on both sides of the film strip when the one or plural projecting portions serve as basic contact portions, to the larger-diameter rod and the outer surface of the smaller-diameter rod at a predetermined pressure;

a holding tube into which the antenna element is held insertably;

O-shaped ring seal means attached to an opening of the holding tube so as to contact the largest-diameter portion of the antenna element fluid-tightly;

an extending/retracting mechanism for extending the antenna element by projecting the smallest-diameter rod of the antenna element outside another rod and retracting the antenna element by pulling the smallest-diameter rod into another rod;

displacement means for displacing the largest-diameter rod outside the holding tube when the antenna element starts to be extended by the extending/retracting mechanism to shift the rods from a first state in which a top portion attached to the tip portion of the smallest-diameter rod is located in an opening of the holding tube to a second shift in which a tip portion of the largest-diameter rod is located in the opening of the holding tube;

extension means for, after the rods are shifted to the second state by the displacement means, extending the antenna element using the extending/retracting mechanism to project each of the rods outside the largest-diameter rod;

retraction means for retracting the antenna element using the extending/retraction mechanism to pull each of the rods into the largest-diameter rod and set the largest-diameter rod in the second state; and means for, after the antenna element is retracted by the retraction means, pulling the largest-diameter rod into an initial position of the holding tube when the antenna element ends the retraction operation performed by the extending/retracting mechanism and set the antenna element to the first state.

* * * * *